US010215525B2

(12) United States Patent
Zhu

(10) Patent No.: US 10,215,525 B2
(45) Date of Patent: Feb. 26, 2019

(54) PNEUMATIC AIR GUN

(71) Applicant: Zhongshan New Swan Technology Co., Ltd., Zhongshan (CN)

(72) Inventor: Zuopeng Zhu, Zhongshan (CN)

(73) Assignee: ZHONGSHAN NEW SWAN TECHNOLOGY CO., LTD., Zhongshan (CN)

( * ) Notice: Subject to any disclaimer, the term of this patent is extended or adjusted under 35 U.S.C. 154(b) by 0 days.

(21) Appl. No.: 15/795,224

(22) Filed: Oct. 26, 2017

(65) Prior Publication Data

US 2018/0045484 A1 Feb. 15, 2018

Related U.S. Application Data

(63) Continuation-in-part of application No. PCT/CN2016/077178, filed on Mar. 24, 2016.

(30) Foreign Application Priority Data

Jan. 15, 2016 (CN) ..... 2016 2 0040534 U

(51) Int. Cl.

| | |
|---|---|
| ***F41B 11/68*** | (2013.01) |
| ***F41B 11/681*** | (2013.01) |
| ***F41B 11/50*** | (2013.01) |
| ***F41B 11/721*** | (2013.01) |
| ***F41B 11/73*** | (2013.01) |
| ***F41B 11/724*** | (2013.01) |
| ***F41B 11/52*** | (2013.01) |

(Continued)

(52) U.S. Cl.

CPC ..... *F41B 11/681* (2013.01); *F41B 11/50* (2013.01); *F41B 11/52* (2013.01); *F41B 11/683* (2013.01); *F41B 11/721* (2013.01); *F41B 11/723* (2013.01); *F41B 11/724* (2013.01); *F41B 11/73* (2013.01)

(58) Field of Classification Search

CPC ..... F41B 11/00; F41B 11/64; F41B 11/641; F41B 11/648; F41B 11/681; F41B 11/682; F41B 11/683; F41B 11/72; F41B 11/73

USPC ..... 124/63, 65, 69, 70

See application file for complete search history.

(56) References Cited

U.S. PATENT DOCUMENTS 1,240,989 A * 9/1917 Lefever ..... F41B 11/72 124/69

2,299,073 A * 10/1942 Beasley ..... F41B 11/683 124/69

(Continued)

*Primary Examiner* — Joshua E Freeman

(74) *Attorney, Agent, or Firm* — Matthias Scholl P.C.; Matthias Scholl

(57) ABSTRACT

A pneumatic air gun including a gun support, a barrel disposed on the gun support, a valve body, a pressure gauge, an air compression assembly, an energy storage assembly, and a triggering assembly. The air compression assembly is connected to the energy storage assembly, and the energy storage assembly is connected to the valve body. The triggering assembly includes a trigger support fixed to the gun support and a pull-bolt assembly, a trigger, a trigger button, and a hammer disposed on the trigger support. A spring is attached to the hammer. The trigger is connected to the trigger button. A loading thimble in the pull-bolt assembly slides on the gun support. The loading thimble is movably connected to the hammer and is adapted to control the hammer to reset and to be clamped on the trigger button.

10 Claims, 13 Drawing Sheets

(51) Int. Cl.
*F41B 11/683* (2013.01)
*F41B 11/723* (2013.01)

(56) References Cited

U.S. PATENT DOCUMENTS 3,308,803 A * 3/1967 Fritz ..... F41B 11/68 124/37
5,224,465 A * 7/1993 Milliman ..... F41B 11/723 124/69
5,570,676 A * 11/1996 Gore ..... F41B 11/642 124/56
5,617,837 A * 4/1997 Momirov ..... F41B 11/683 124/69
5,761,840 A * 6/1998 Martin ..... F41B 11/51 42/11
6,343,598 B1 * 2/2002 Pshenychny ..... F41B 11/683 124/60
9,157,695 B1 * 10/2015 Gore ..... F41B 11/642
9,267,757 B2 * 2/2016 Li ..... F41B 11/723
9,404,707 B2 * 8/2016 Gore ..... F41B 11/647
9,562,738 B2 * 2/2017 Hanson ..... F41B 11/642
2003/0075161 A1 * 4/2003 Fujimoto ..... F41B 11/62 124/76
2003/0094167 A1 * 5/2003 Nibecker, Jr. ..... F41B 11/683 124/64
2010/0212481 A1 * 8/2010 Koth ..... F41A 1/00 89/7
2012/0125305 A1 * 5/2012 Zafer ..... F41B 11/683 124/65
2015/0053194 A1 * 2/2015 Li ..... F41B 11/683 124/69
2016/0161212 A1 * 6/2016 Bergeron ..... F41B 11/68 124/73
2018/0058801 A1 * 3/2018 Gore ..... F16F 9/02
2018/0149445 A1 * 5/2018 Lamboy ..... F41B 11/683

* cited by examiner

PNEUMATIC AIR GUN

CROSS-REFERENCE TO RELATED APPLICATIONS

This application is a continuation-in-part of International Patent Application No. PCT/CN2016/077178 with an international filing date of Mar. 24, 2016, designating the United States, now pending, and further claims foreign priority to Chinese Patent Application No. 201620040534.1 filed Jan. 15, 2016. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The present disclosure relates to a pneumatic air gun.

Description of the Related Art

Conventional pneumatic air guns are of pre-compressed pneumatic (PCP) type and have the following disadvantages in terms of performance and structure:

1. The steel pellets that are propelled by air guns need to be placed into the barrel or loaded into the barrel through a spring prior to use, which makes it inconvenient to carry the guns and load the pellets.
2. The velocity of the pellets cannot be adjusted, which negatively affects the user experience.
3. The air release valve assembly of the guns has a certain degree of air leak due to the poor sealing.
4. Existing pull-bolt guns are of lever type, increasing the difficulty in directly shooting steel pellets.
5. The barrel has only one air inlet hole, which has a negative impact on air inlet efficiency and is disadvantageous in increasing the initial velocity of the pellets.
6. The mounting and fixing structures of the magazine are complex and expensive.
7. The air charging process is mainly single stage which provides a limited pressure and inlet air volume.

SUMMARY OF THE INVENTION

It is one objective of the present disclosure to provide a pneumatic air gun that is capable of storing multi-stage compressed air energy and features good user experience.

To achieve the above objective, in accordance with one embodiment of the present disclosure, there is provided a pneumatic air gun comprising a gun support, a barrel disposed on the gun support, a valve body, a pressure gauge, an air compression assembly, an energy storage assembly, and a triggering assembly. The air compression assembly is connected to the energy storage assembly, and the energy storage assembly is connected to the valve body.

The triggering assembly comprises a trigger support fixed to the gun support and a pull-bolt assembly, a trigger, a trigger button, and a hammer disposed on the trigger support. A spring is attached to the hammer. The trigger is connected to the trigger button. A loading thimble in the pull-bolt assembly slides relatively on the gun support. The loading thimble is movably connected to the hammer to control the hammer to reset and be clamped on the trigger button. The energy storage assembly comprises an air pump and a check valve disposed at an end of the air pump. The air pump is a three-stage air pump. The valve body comprises an air release passage adapted to connect the check valve and the barrel. The air release passage is provided with an air release valve for controlling the opening and closing of an air channel. The air release passage between the air release valve and the barrel is further provided with a speed-regulation valve for regulating an air flow. The air release valve is provided with a slider for controlling the opening or closing of the air release passage. The slider is positioned at the end of a striking travel of the hammer.

The three-stage air pump further comprises a front fixed sheath, a rear fixed sheath, a front movable sheath, a rear movable sheath, a relatively large tube, a medium tube, a relatively small tube, and a piston rod. An intake sleeve on the check valve is sealed and fixedly connected in the rear fixed sheath.

Front and rear ends of the relatively large tube are sheathed tightly on the front fixed sheath and the rear fixed sheath respectively. The front fixed sheath and the rear fixed sheath are both fixedly connected to the gun body support through a connection portion that extends out of the relatively large tube. An O-ring of the relatively large tube seals between an inner wall of a rear end of the relatively large tube between an outer wall of the rear fixed sheath.

The front movable sheath is positioned at a front portion of the relatively large tube. A steel ball is provided on an outer circumference of the front movable sheath. The front movable sheath is slidably mated to the inner wall of the relatively large tube through the steel ball. The rear movable sheath is positioned at a rear portion of the relatively large tube. A first-stage piston cup is provided between the outer wall of the rear movable sheath and the inner wall of the relatively large tube. The first-stage piston cup, which is opened upon air admission and closed upon air compression, is fixed to the outer wall of the rear movable sheath.

The medium tube is coaxially disposed in the relatively large tube. The front and rear ends of the medium tube is tightly sheathed in the front movable sheath and rear movable sheath respectively. The relatively small tube is coaxially disposed in the medium tube. The rear end of the relatively small tube is sealed and fixedly connected in an intake sleeve on the check valve. A second-stage piston cup is provided between the inner wall of the rear movable sheath and the outer wall of the relatively small tube. The second-stage piston cup, which is closed upon air admission and opened upon air compression, is fixed to the inner wall of the rear movable sheath.

The piston rod is positioned in the relatively small tube. One end of the piston rod extends out of the relatively small tube and is hinged to the front movable sheath through a pin shaft of the front movable sheath. A third-stage piston cup is provided between the other end of the piston rod and the inner wall of the relatively small tube. The third-stage piston cup, which is opened upon air admission and closed upon air compression, is fixed to a piston head of the piston rod.

The air compression assembly comprises a connection bar and a compression bar. One end of the connection bar is rotatably connected to the front movable sheath through a pin shaft of the connection bar. The compression bar is rotatably connected to the front fixed sheath through a front pin shaft of the compression bar. The other end of the connection bar is rotatably connected to a middle portion of the compression bar through a rear pin shaft of the compression bar.

In a class of this embodiment, the air release valve comprises a valve core shaft, an air release valve spring, and a valve cover. The valve core shaft is sheathed in the valve cover to be axially slidable and is controlled by the air release valve spring to reset. The valve cover comprises an axial airflow through hole and a circumferential outlet port that is in communication with the airflow through hole. A step is circumferentially arranged on and protrudes from the inner wall of the airflow through hole. One end of the valve cover is an inlet port and the other end of the valve cover is connected with the slider that has a hat shape. The slider is positioned in the valve cover and axially slidably mated to the valve cover. The valve core shaft is axially slidably mated to the step. An inner end of the valve core shaft extends into the slider to be fixedly connected with the slider. A first O-ring is provided between the valve core shaft and the valve cover. The first O-ring is fitted tightly on the valve core shaft and can abut on the stage face of the step. The other side of the O-ring is also provided with a gasket which is fitted tightly on the valve core shaft and abuts against the first O-ring. The gasket is slidably mated to the inner wall of the valve cover. One end of the air release valve spring is pressed against the gasket and the other end of the air release valve spring is pressed against the slider. The outer end of the valve core shaft has a large tip which can be snugly fitted to the inlet port of the valve cover. A second O-ring is provided between the large tip and an end face of the intake port for sealing the intake port. The second O-ring is provided on the end face of the intake port or the large tip.

In a class of this embodiment, the speed-regulation valve comprises a speed-regulation valve core which is pivotally mounted in the air release passage and can be rotated about the center thereof. The speed-regulation valve core is arranged perpendicularly to the air release passage. The speed-regulation valve core is provided with a plurality of air guide holes. The air guide holes are arranged along the outer circumference of the speed-regulation valve core at an angle with respect to one another and pass through the speed-regulation valve core radially. Each of the air guide holes has a diameter different from one another. An end of the speed-regulation valve core extends out of the valve body. The outer end of the speed-regulation valve core is provided with a speed-regulation knob which can drive the speed-regulation valve core to rotate so as to switch between various air guide holes and the air release passage.

In a class of this embodiment, a rotary positioning steel ball is provided between the speed-regulation valve core and the valve body. A counterbore is provided on the side of the speed-regulation knob that faces the valve body. A spring for rotary positioning is provided in the counterbore. The rotary positioning steel ball is positioned in the counterbore and is pressed against an outer end of the spring for rotary positioning. The rotary positioning steel ball is always pressed against an outer surface of the valve body to slide thereon under the tension of the spring for rotary positioning.

In a class of this embodiment, the pull-bolt assembly comprises a pull-bolt pull bar and a pull-bolt thimble. The portion of the pull-bolt pull bar that extends out of the gun support is provided with a pull-bolt handle. The pull-bolt thimble has a top end capable of magnetically attracting a steel pellet.

In a class of this embodiment, the top end of the pull-bolt thimble is formed with a bore in which a magnetic shaft capable of magnetically attracting a steel pellet is provided.

In a class of this embodiment, the valve body is provided with a tube for mounting a barrel. An inner end of the barrel extends into the tube. The air release passage comprises two or more inlet holes in communication with the tube. Each inlet hole has an inner diameter smaller than an outer diameter of the pellet.

In a class of this embodiment, a magazine comprising a pellet clip seat, a pellet clip lid, a pellet clip closure, and a magnetic shaft is detachably connected to the air gun support. The pellet clip seat and the pellet clip lid are connected to constitute a magazine case that comprises a pellet inlet on its upper end. The pellet clip closure is rotatably connected to the magazine case for opening or closing of the pellet inlet. The bottom side wall of the pellet clip seat is provided with a loading sleeve that extends to the pellet clip lid. A center hole of the loading sleeve is perpendicularly penetrated through the pellet clip seat. The pellet clip lid comprises a loading channel for the pull-bolt thimble to pass through. The loading sleeve comprises an opening at the end thereof close to an exit side of the loading channel through which a single pellet can slip autonomously into the loading channel. The bottom of the loading channel comprises a shaft bore close to the opening that is in communication with the loading channel. The magnetic shaft is tightly fitted in the shaft bore. The magnetic shaft is a magnet shaft capable of magnetically attracting a steel pellet that enters the loading channel through the opening to the top end thereof. An upper end of the magnetic shaft is flush with an upper edge of the shaft bore or hidden inside the shaft bore.

The upper end of the valve body is provided with a groove for inserting the magazine case into the valve body. The magazine case is inserted in the groove. The bottom of the magazine case is provided with an inverted T shaped connector. The connector comprises a clamping edge protruding outward on both sides of its bottom and a positioning block protruding downward at one side of its bottom end. The bottom of the groove is provided with a connector slot capable of mating to the connector, the bottom of the connector slot is provided with a positioning counterbore capable of mating to the positioning block. Both side walls of the connector slot are provided with a concave bayonet. One of the side clamping edges of the connector can be inserted into one of the side bayonets at an angle. The other side clamping edge of the connector can be folded down to be clamped in the other bayonet to achieve a clamping connection of the magazine. The positioning block protrudes into the positioning counterbore when the magazine case is fully clamped in the connector slot.

In a class of this embodiment, the lower end face of the connector is provided with a counterbore. A pillar is provided at the center of the counterbore. The pillar is hidden inside the counterbore. An O-shaped rubber ring is positioned in the counterbore and tightly fitted on the pillar. The O-shaped rubber ring protrudes from the lower end face of the connector.

Advantages of the pneumatic air gun according to embodiments of the invention are as follows.

1. The three-stage air pump principle is adopted, that is, a multi-stage sleeve is used to form three air chambers to achieve a step-by-step boost so as to obtain a high pressure and a high air volume required by the functional performance. A lever and a handle are used in combination to reduce the force necessary for air compression. By using a three-stage air pump in a gun and using the principle of leverage for air compression, the balance between the pressure and the compressed air volume and the compression force applied to the bar can be improved, thereby improving the performance of the gun.

2. The front movable sheath is slidably mated to the inner wall of the relatively large tube through a steel ball, thereby resulting in a stable air admission and compression motion.
3. In the present disclosure, a step is arranged circumferentially on and protrudes from the inner wall of the valve cover. A first O-ring abuts against the stage face of the step, and the second O-ring is provided at the end face of the inlet port or the large tip. Such a structural design allows steel to steel contact fitting between the valve core shaft and the step on the inner wall of the valve cover, and thus ensures a high degree of coaxiality and can avoid an excessively long fitting interval between the outer circumference of the valve core shaft and the inner wall of the valve cover as in prior art, which may result in the disadvantage of a large coaxiality error between the valve core shaft and the valve cover. As such, the axial movement stability of the valve core shaft is improved. In a high pressure state, the characteristics of a low rigidity and a desirable sealing of the O-ring are utilized to achieve reliable sealing. Meanwhile, rigid positioning between the step and the end face is utilized to protect the O-ring.
4. Between the valve cap and the air outlet hole, a first O-ring is provided between the valve core shaft and the valve cover. The first O-ring is fitted tightly on the valve core shaft and can abut against the stage face of the step. A gasket is further provided on the other side of the first O-ring. The gasket is fitted on the valve core shaft and abuts against the first O-ring. One end of the air release valve spring is pressed against the gasket, and the other end of the air release valve spring is pressed against the valve cap. The gasket is slidably mated to the inner wall of the valve cover. The gasket serves to protect the first O-ring from the pressure exerted directly by the air release valve spring. The step is used for positioning, allowing the first O-ring to rest upon the stage face of the step, thereby facilitating protection of the first O-ring.
5. A hole is formed at a front end of the pull-bolt thimble for receiving a magnetic shaft (a magneto-optical pellet shaft). When the pull-bolt thimble enters the chamber, the pellet also enters the chamber and is magnetically stabilized at the front end of the pull-bolt thimble. The steel pellet can be propelled under the action of an air flow. Such a structure is simple and easy to use.
6. A damping rubber seal ring is mounted at the root of the pull-bolt thimble so as to achieve a damping effect for the pull-bolt. An elastic rubber seal ring, which is self-locked upon loading by the pull-bolt thimble, is arranged on the outer circumference of the pull-bolt thimble. As such, self-locking of the elastic rubber seal ring upon loading by the pull-bolt thimble is achieved by using the elasticity of the seal ring.
7. The present disclosure adopts a plurality of air inlet holes to increase the cross section of the air inlet hole of the barrel, which is advantageous for increasing the air intake volume of the barrel and increasing the initial velocity of the pellet. The air inlet holes have an inner diameter smaller than an outer diameter of the pellet. Therefore, the pellet cannot enter the air inlet hole. Such a structure is simple and practical.
8. The speed-regulation valve core is driven by the speed-regulation knob to rotate in order to switch between various air guide holes and the air release passage. As such, during rotation of the speed-regulation valve core, air guide holes of difference diameters are aligned with the air release passage. As the air guide holes each have a different cross section, different air flows can be achieved for the purpose of adjusting the initial velocity of the pellet to meet various velocity requirements in various usage situations.
9. A rotary positioning steel ball is provided between the speed-regulation valve core and the valve body. The rotary positioning steel ball is always pressed against the outer surface of the valve body to slide thereon under the tension of the spring so that the rotation damping of the speed-regulation knob is increased, thus facilitating the rotary positioning of the speed-regulation valve core.
10. The bottom of the magazine case is provided with an inverted T shaped connector that comprises a clamping edge protruding outward at both sides of its bottom. The bottom of the groove is provided with a connector slot capable of mating to the connector. Both side walls of the connector slot are provided with a concave bayonet. One of the side clamping edges of the connector can be inserted into one of the side bayonets at an angle. The other side clamping edge of the connector can be folded down to be clamped in the other bayonet to achieve clamping connection of the magazine. With a structural design in which the T shaped connector mates to the connector slot, the magazine can be mounted reliably.
11. The bottom end of the connector is provided with a positioning block protruding downward at one end thereof. The bottom of the connector slot is provided with a positioning counterbore capable of mating to the positioning block. The positioning block protrudes into the positioning counterbore when the magazine is fully clamped into the connector slot. The use of a protruding positioning block for positioning can prevent reversed installation and can allow reliable positioning.
12. The lower end face of the connector has a counterbore. A pillar is provided at the center of the counterbore and hidden inside the counterbore. An O-shaped rubber ring is positioned in the counterbore and tightly fitted on the pillar. The O-shaped rubber ring protrudes from the lower end face of the connector. With such an O-shaped rubber ring protruding from the lower end face of the connector, when the groove is engaged with the magazine, the O-shaped rubber ring maintains an opposite thrust to the clip to enable the groove to grip the magazine tightly, thereby achieving a secure connection between the groove and the magazine.
13. The pellet clip seat and the pellet clip lid are connected to form a magazine case. A pellet inlet is formed at the upper end of the magazine case. The pellet clip closure is rotatably connected to the magazine case for opening or closing of the pellet inlet. Such a structural design enables a large number of pellets to be stored in a standalone magazine case, thereby making it easy to be carried. Meanwhile, a pellet clip closure with resistance is used to close the pellet inlet, so that the pellets cannot drop out easily.
14. The bottom side wall of the pellet clip seat is provided with a loading sleeve that extends to the pellet clip lid. A center hole of the loading sleeve is perpendicularly penetrated through the pellet clip seat, and the pellet clip lid comprises a loading channel for the pull-bolt thimble to pass through. The loading sleeve comprises an opening at the end thereof close to the pellet inlet side through which a single pellet can slip autonomously into the loading channel. The bottom of the loading channel comprises a shaft bore that is in communication with the loading channel. The shaft bore is close to the opening. The magnetic shaft is tightly fitted in the shaft bore. The magnetic shaft is a magnet shaft which can magnetically attract a steel pellet entering the loading channel through the opening to the top end thereof. An upper end of the magnetic shaft is flush with an upper edge of the shaft bore or hidden inside the shaft bore. With regard to introduction of a pellet, such a structural design enables a pellet to enter the loading channel autonomously under its own weight. Also, since only one pellet can be introduced at a time and is positioned through the magnetic shaft (which is a highly magneto-optical shaft), the pellets can be introduced accurately.

DETAILED DESCRIPTION OF THE EMBODIMENTS

Figure 1:
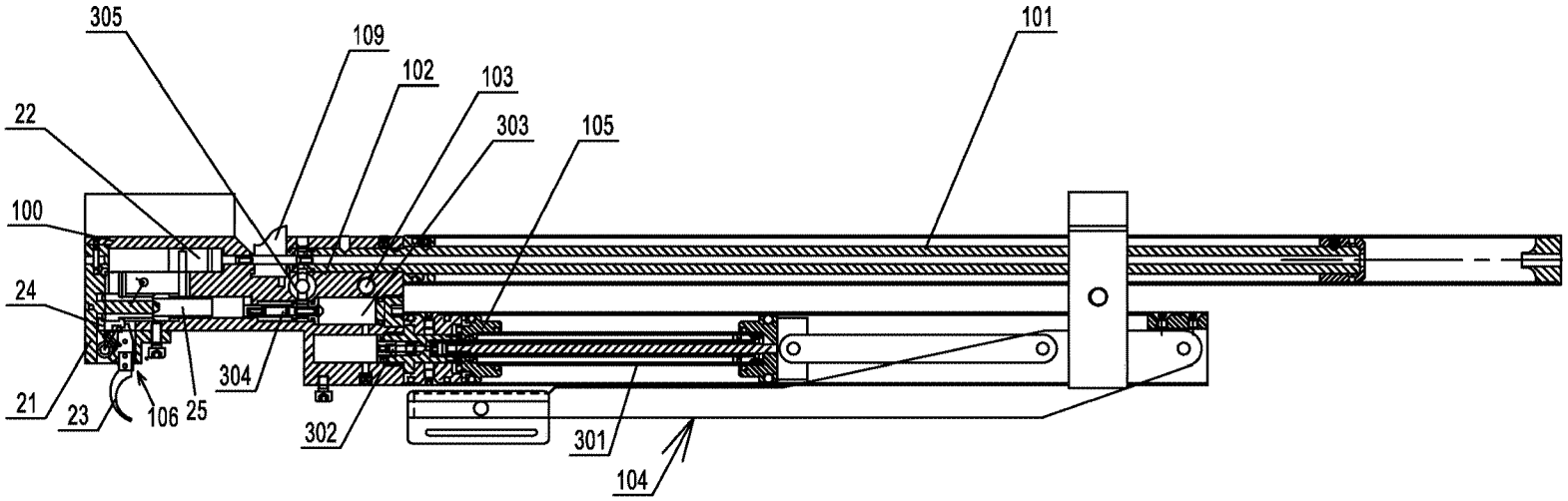
FIG. 1 is a schematic cross-sectional structural view of the present disclosure.
Figure 2:
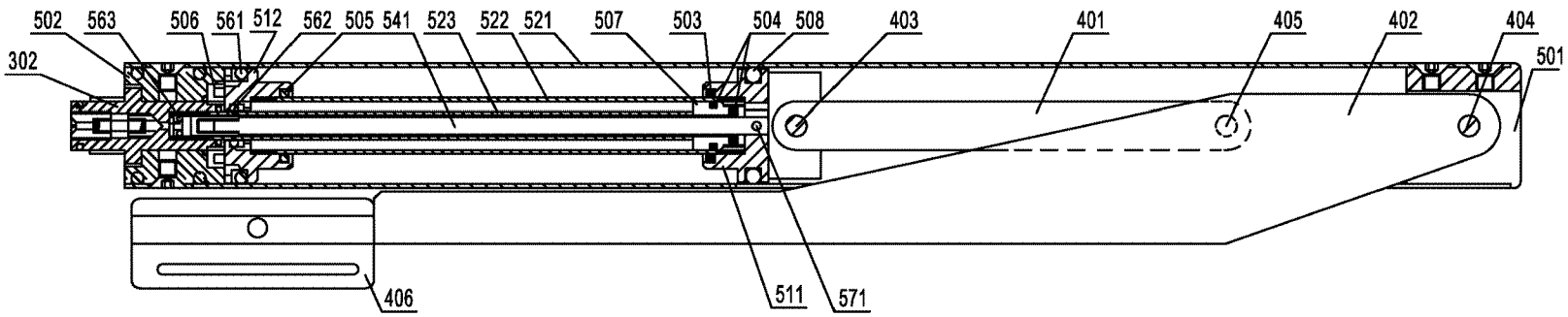
FIG. 2 is a schematic cross-sectional structural view of an air compression assembly and an energy storage assembly.
Figure 3:
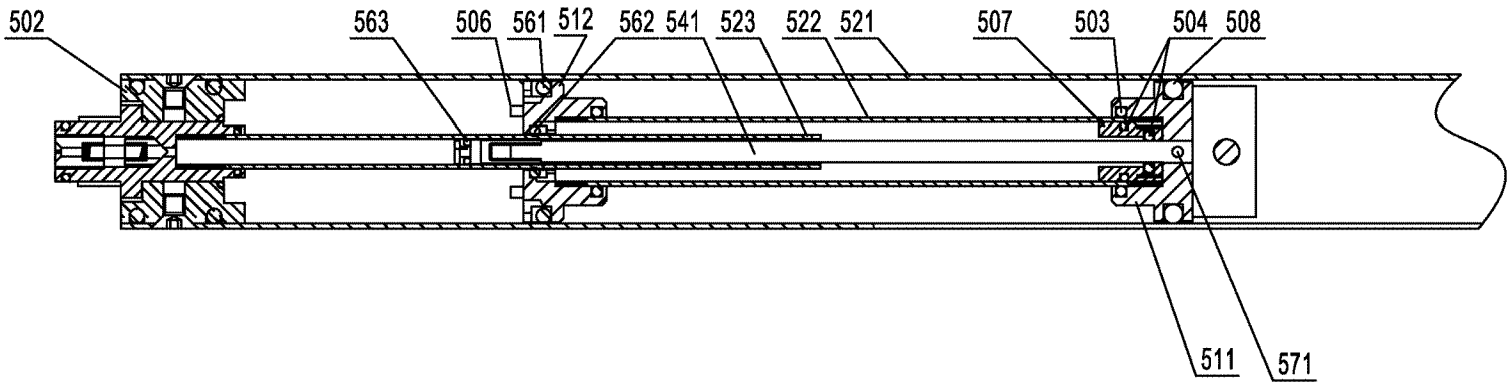
FIG. 3 is a schematic cross-sectional structural view of the air compression assembly in an intermediate state between air admission and compression.
Figure 4:
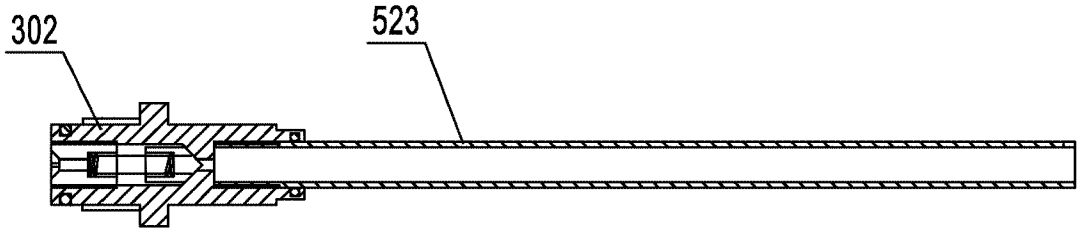
FIG. 4 is a schematic cross-sectional structural view of a relatively small tube and a check valve when assembled.
Figure 5:
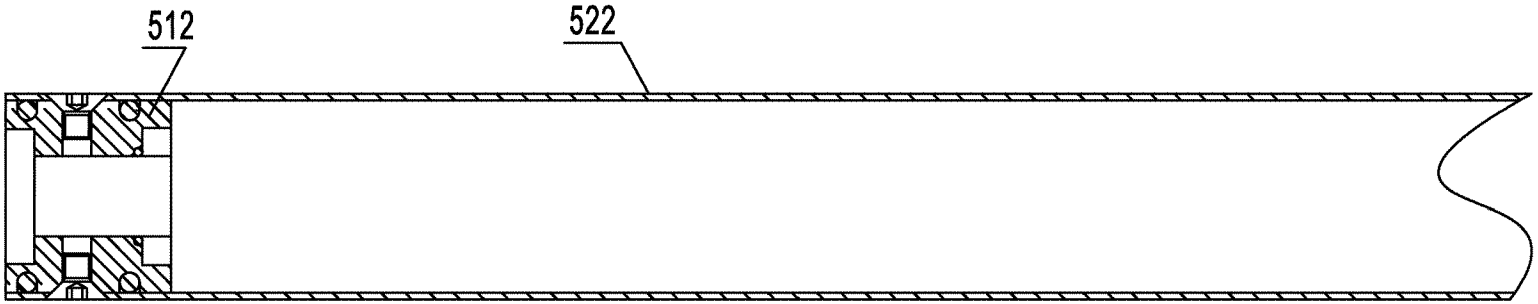
FIG. 5 is a schematic cross-sectional structural view of a relatively large tube and a rear fixed sheath.
Figure 6:
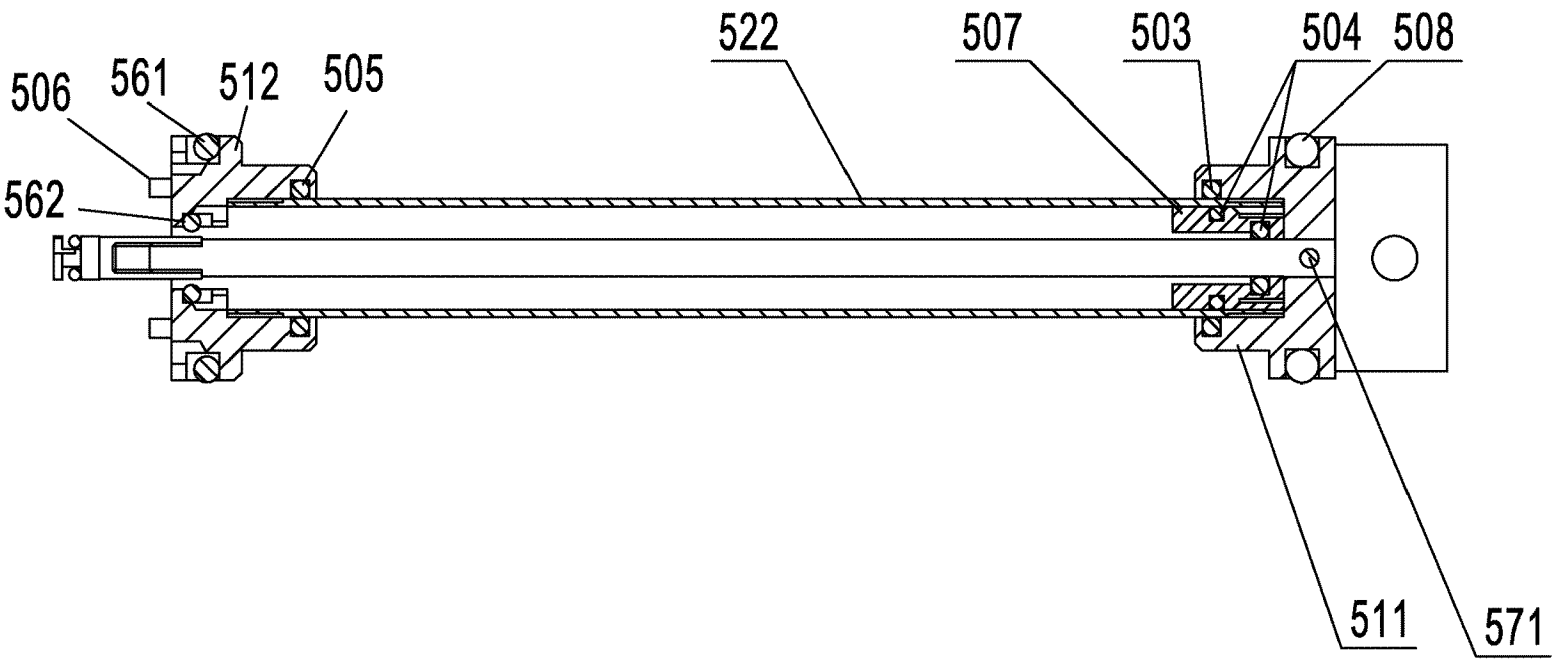
FIG. 6 is a cross-sectional view of a medium tube, a front movable sheath, and a rear movable sheath.

As shown in FIGS. 1 to 20, a pneumatic air gun with multi-stage compressed air energy storage comprises a gun support 100 and a barrel 101 disposed on the gun support, a valve body 102, a pressure gauge 103, an air compression assembly 104, an energy storage assembly 105, and a triggering assembly 106. The air compression assembly 104 is connected to the energy storage assembly 105, and the energy storage assembly 105 is connected to the valve body 102.

The triggering assembly 106 comprises a trigger support 21 fixed to the gun support 100 and a pull-bolt assembly 22, a trigger 23, a trigger button 24, and a hammer 25 disposed on the trigger support 21. A spring is fastened to the hammer 25. The trigger 23 is connected to the trigger button 24. A loading thimble in the pull-bolt assembly 22 slides relatively on the gun support 100. The loading thimble is movably connected to the hammer 25 to control the hammer 25 to reset and be clamped on the trigger button 24.

The energy storage assembly 105 comprises an air pump 301 and a check valve 302 disposed at an end of the air pump 301. The valve body 102 comprises an air release passage 303 adapted to connect the check valve 302 and the barrel 101. The air release passage 303 is provided with an air release valve 304 capable of controlling the opening and closing of an air channel. The air release passage 303 between the air release valve 304 and the barrel 101 is further provided with a speed-regulation valve 305 for regulating an air flow. The air release valve 304 is provided with a slider for controlling the opening or closing of the air release passage 303. The slider is positioned at the end of the striking travel of the hammer 25.

When the air compression assembly compresses air to the check valve 302, the high pressure air presses and opens the check valve 302 and is enclosed in an inlet port of the air release valve 304. When the triggering assembly 106 is pulled, the hammer 25 strikes the slider at the end of its travel to open the air release valve 304. Then high pressure air enters the barrel 101 via the air release valve 304 and the speed-regulation valve 305 to propel the pellet.

As shown in FIGS. 2 to 6, in this embodiment, the air pump 301 is a three-stage air pump. The three-stage pump 301 comprises a front fixed sheath 501, a rear fixed sheath 502, a front movable sheath 511, a rear movable sheath 512, a relatively large tube 521, a medium tube 522, a relatively small tube 523, and a piston rod 541. An intake sleeve on the check valve 302 is sealed and fixedly connected into the rear fixed sheath 502. Front and rear ends of the relatively large tube 521 are sheathed tightly on the front fixed sheath 501 and the rear fixed sheath 502 respectively. The front fixed sheath 501 and the rear fixed sheath 502 are both fixed to the gun body support 1 through a connection portion that extends out of the relatively large tube 521. An O-ring 551 of the relatively large tube seals between an inner wall of the relatively large tube 521 at its rear end and an outer wall of the rear fixed sheath 502.

The front movable sheath 511 is positioned in a front portion of the relatively large tube 521. A steel ball 508 is provided at an outer circumference of the front movable sheath 511. The front movable sheath 511 is slidably mated to an inner wall of the relatively large tube 521 through the steel ball 508. The rear movable sheath 512 is positioned in a rear portion of the relatively large tube 521. A first-stage piston cup 561 is provided between the outer wall of the rear movable sheath 512 and the inner wall of the relatively large tube 521. The first-stage piston cup 561, which is opened upon air admission and closed upon air compression, is fixed to an outer wall of the rear movable sheath 512.

The medium tube 522 is coaxially disposed in the relatively large tube 521. The front and rear ends of the medium tube 522 are sheathed tightly in the front movable sheath 511 and the rear movable sheath 512 respectively. The rear movable sheath 512 is tightened to the medium tube 522 through a nut 506. A rear joint bushing in the form of an O-ring 505 is provided between the rear movable sheath 512 and the medium tube 522. A joint bushing 507 is provided in the medium tube 522 and the inner wall of the front movable sheath 511 and is sheathed on the front end of the medium tube. An inner joint bushing in the form of an O-ring 504 and an outer joint bushing in the form of an O-ring 503 are provided respectively between the inner wall of the medium tube 522 and an outer wall of the joint bushing 507 and between the outer wall of the medium tube 522 and the inner wall of the front movable sheath 511. The relatively small tube 523 is disposed coaxially in the medium tube 522. The relatively small tube 523 is sealed at its rear end and is fixedly connected in the intake sleeve on the check valve 302. A second-stage piston cup 562 is provided between the inner wall of the rear movable sheath 512 and the outer wall of the relatively small tube 523. The second-stage piston cup 562, which is closed upon air admission and opened upon air compression, is fixed to the inner wall of the rear movable sheath 512.

The piston rod 541 is positioned in the relatively small tube 523. One end of the piston rod 541 extends out of the relatively small tube 523 and is hinged to the front movable sheath 511 through a pin shaft 571 of the front movable sheath. A third-stage piston cup 563 is provided between the other end of the piston rod 541 and the inner wall of the relatively small tube 523. The third-stage piston cup 563, which is opened upon air admission and closed upon air compression, is fixed to the piston head of the piston rod 541.

In this embodiment, the air compression assembly 104 comprises a connection bar 401 and a compression bar 402. One end of the connection bar 401 is rotatably connected to the front movable sheath 511 through a pin shaft 403 of the connection bar. The compression bar 402 is rotatably connected to the front fixed sheath 501 through the front pin shaft 404 of the compression bar. The other end of the connection bar 401 is rotatably connected to a middle portion of the compression bar 402 through a rear pin shaft 405 of the compression bar. The compression bar 402 is provided with a handle 406. For air compression, the air compression assembly 104 drives the piston rod 541 to perform air compression. The air admission and compression process of the piston rod 541 is as follows.

In a first step of air admission, the connection bar 401 drives the piston rod 541 to move forward for air admission. In this process, the first-stage piston cup 561 opens under an external air pressure to allow air into the relatively large tube 521. In this process, the second-stage piston cup 562 closes under the air pressure between the medium tube 522 and the relatively small tube 523. In this process, the third-stage piston cup 563 opens under the air pressure between the medium tube 522 and the relatively small tube 523 to allow the air into the relatively small tube 523.

In a second step of air compression, the connection bar 401 drives the piston rod 541 to move backward for air compression. In this process, the first-stage piston cup 561 closes under the air pressure enclosed in the relatively large tube 521 to be isolated from the external environment. In this process, the second-stage piston cup 562 opens under the air pressure between the medium tube 522 and the relatively small tube 523 to allow the first-stage compressed air in the relatively large tube 521 to enter in between the medium tube 522 and the relatively small tube 523 for preparation of a second-stage air compression for the next air admission. In this process, the third-stage piston cup 563 closes under the air pressure enclosed in the relatively small tube 523. The compressed air enters the air release passage 303 via the check valve 302 and is enclosed in the air release passage 303 between the check valve 302 and the air release valve 304.

In a third step, the operation in the first and second steps are repeated to perform repeated air compression until the pressure gauge 103 has reached the required pressure value and then the gun is ready to shoot.

Figure 7:
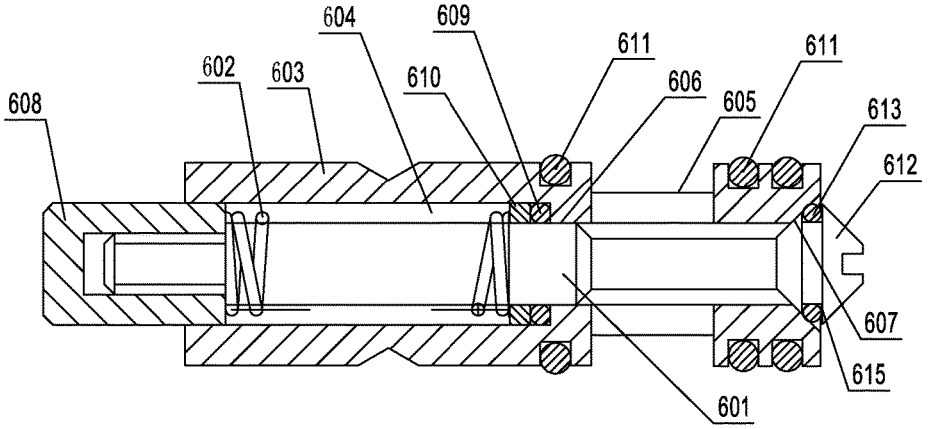
FIG. 7 is a schematic cross-sectional structural view of an air release valve according to a first embodiment.
Figure 8:
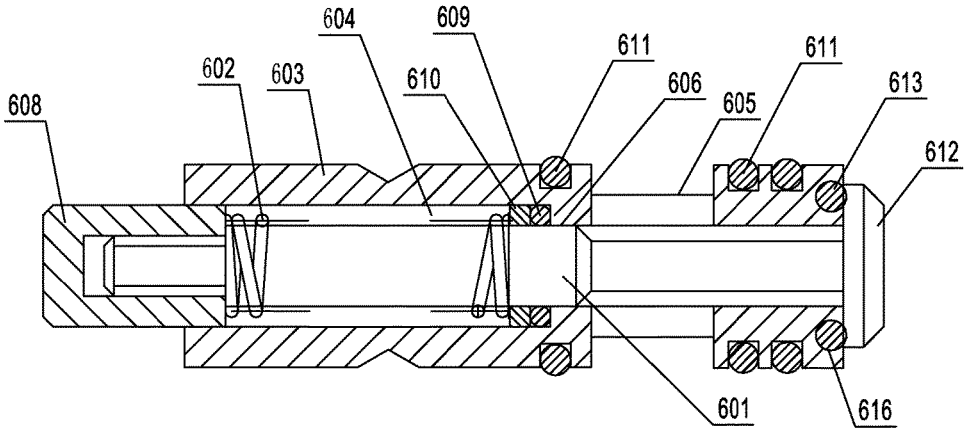
FIG. 8 is a schematic cross-sectional structural view of an air release valve according to a second embodiment.

As shown in FIGS. 1, 7, and 8, the air release valve 304 comprises a valve core shaft 601, an air release valve spring 602, and a valve cover 603. The valve core shaft 601 is fitted in the valve cover 603 to be axially slidable and is controlled by the air release valve spring 602 to reset. In this embodiment, the valve cover 603 comprises an axial airflow through hole 604 and a circumferential outlet hole 605 in communication with the airflow through hole 604. A step 606 is arranged circumferentially on and protrudes from the inner wall of the airflow through hole 604. One end of the valve cover 603 has an inlet port 607, and the other end of the valve cover 603 is connected to a slider 608 in the shape of a cap. The slider 608 is positioned in the valve cover 603 and is axially slidably mated to the valve cover 603. The valve core shaft 601 is axially slidably mated to the step 606. An inner end of the valve core shaft 601 extends into the slider 608 and is fixedly connected to the slider 608. A first O-ring 609 is provided between the valve core shaft 601 and the valve cover 603. The first O-ring 609 is tightly fitted on the valve core shaft 601 and can abut against the stage face of the step 606. The other side of the first O-ring 609 is provided with a gasket 610. The gasket 610 is fitted on the valve core shaft 601 and can abut against the first O-ring 609. One end of the air release valve spring 602 is pressed against the gasket 610, and the other end of the air release valve spring 602 is pressed against the slider 608. The gasket 610 is slidably mated to the inner wall of the valve cover 603. The gasket 610 serves to protect the first O-ring 609 from the pressure exerted directly by the air release valve spring 602. The step 606 is used for positioning and allows the first O-ring 609 to rest upon the stage face of the step 606, thereby facilitating protection of the first O-ring 609. The first O-ring 609 is a seal ring made of rubber which has a desirable sealing effect. A plurality of third O-rings 611 are provided outside the valve cover 603. The third O-rings 611 are positioned respectively on the left and right sides of the circumferential outlet hole 605.

According to a first embodiment shown in FIG. 7, an outer tend of the valve core shaft 601 is provided with a large tip 612 that can be snugly fitted to the inlet port 607 of the valve cover in a normally closed position. A second O-ring 613 is provided between the large tip 612 and an end face of the inlet port 607 for sealing of the inlet port 607. The second O-ring 613 is disposed at the large tip 612. The inlet end 607 has a frustum-shaped edge of a gradually reduced inner diameter. The large tip 612 has a frustum-shaped outer surface that matches the frustum-shaped edge. A groove 615 is formed along the entire outer circumference of the large tip 612. The second O-ring 613 is fitted tightly in the groove 615, with its outer side protruding from the groove 615. Upon normally closed fitting, the second O-ring 613 seals between the inlet port 607 and the large tip 612. The groove 615 can protect the second O-ring 613 from excess squeezing.

According to a second embodiment shown in FIG. 8, the outer end of the valve core shaft 601 has a large tip that can be snugly fitted to the inlet port of the valve cover. A second O-ring is provided between the inner end face of the large tip and the end face of the inlet port for sealing of the inlet port. The second O-ring is disposed at the outer end face of the inlet port. A slot 616 is provided around the outer end face of the inlet port. The second O-ring is clamped in the slot with its outer side protruding from the slot 616. Upon normally closed fitting, the second O-ring seals between the inlet port and the large tip. The slot 616 can protect the second O-ring from excessive squeezing.

The air release valve 304 is operated as follows:

To shoot the gun, the hammer 25 strikes the slider 608 to allow the slider 608 to slide axially along with the valve core shaft 601, so that the air release valve spring 602 is compressed and the inlet port 607 is opened. High pressure air enters the air release passage 303 via the inlet port 607, the airflow through hole 604, and the circumferential outlet port 605 for preparation of shooting. Once the shooting is done, the hammer is returned to allow the slider 608 and the valve core shaft 601 to reset by sliding together reversely under the tension of the air release valve spring 602. Then the inlet port 607 is closed.

Figure 9:
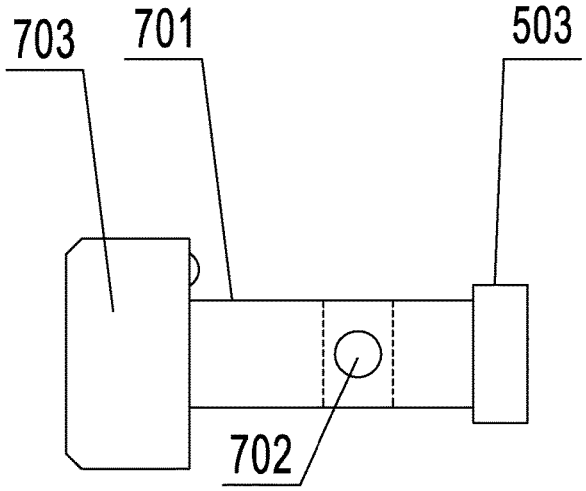
FIG. 9 is a schematic front structural view of a speed-regulation valve core.
Figure 10:
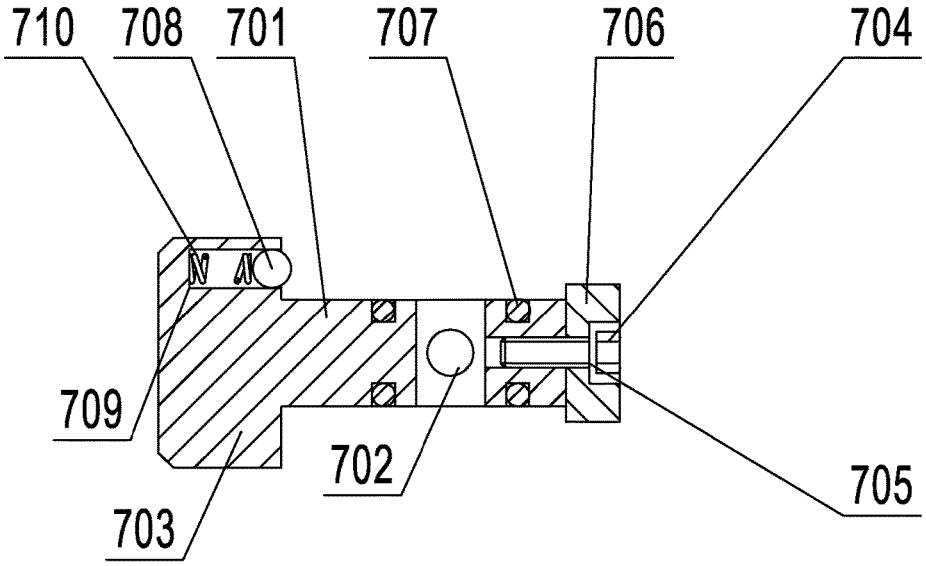
FIG. 10 is a front cross-sectional structural view of the speed-regulation valve core.
Figure 11:
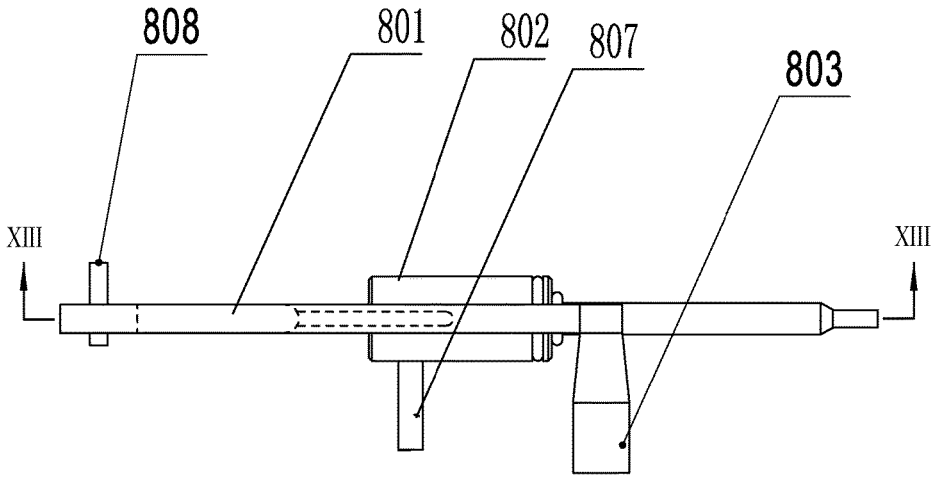
FIG. 11 is a schematic front structural view of a pull-bolt assembly.
Figure 12:
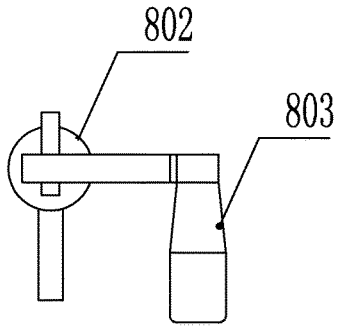
FIG. 12 is a schematic left structural view of a pull-bolt assembly.
Figure 13:
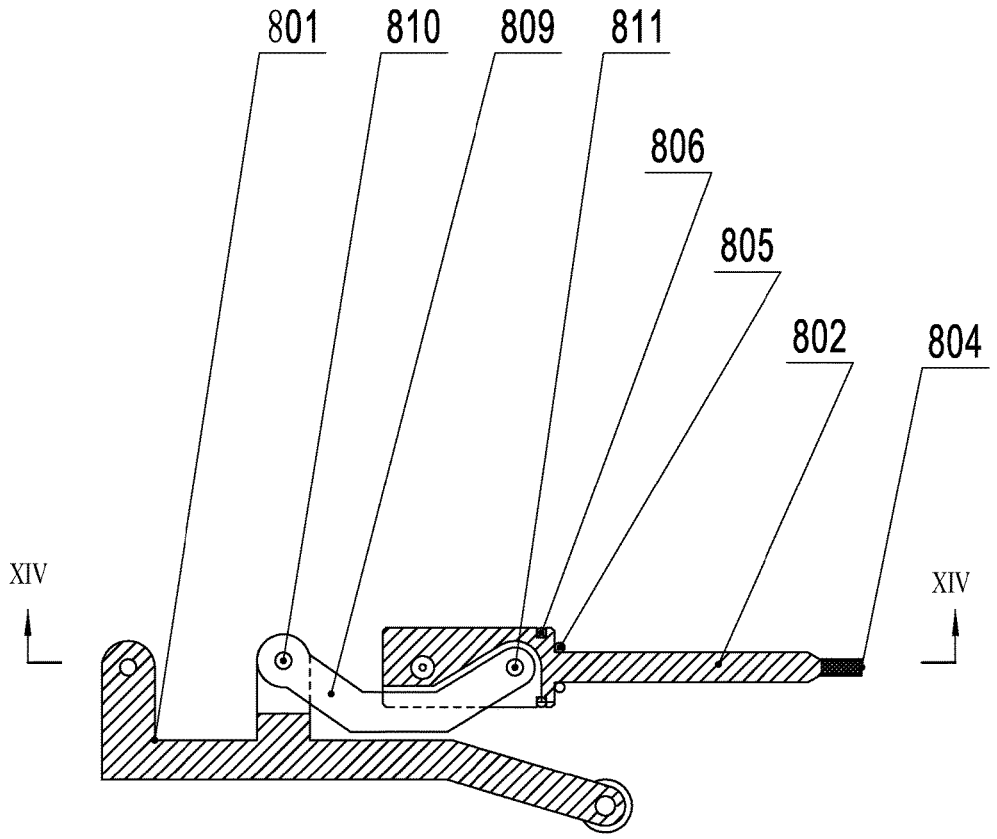
FIG. 13 is a schematic cross-sectional structural view taken along line XIII-XIII in FIG. 11.
Figure 14:
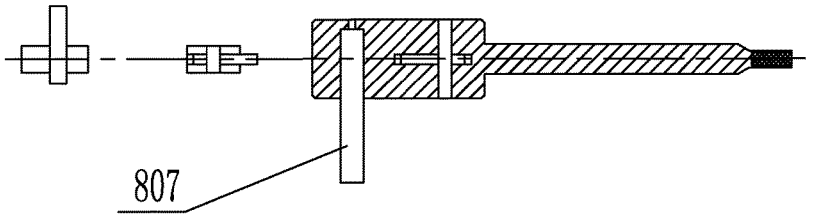
FIG. 14 is a schematic cross-sectional structural view taken along line XIV-XIV in FIG. 13.

As shown in FIGS. 1, 9, and 10, the speed-regulation valve 305 comprises a speed-regulation valve core 701 that is pivotally mounted in the air release passage 303 and can be rotated about the center thereof. The speed-regulation valve core 701 is disposed perpendicular to the air release passage 303. A plurality of air guide holes 702 are formed in the speed-regulation valve core 701. The air guide holes 702 are provided along the outer circumference of the speed-regulation valve 701 at an angle with respect to each other and pass radially through the speed-regulation valve core 701. The air guide holes 701 each have an air guide hole diameter different from one another. One end of the speed-regulation valve core 701 extends out of the valve body 102. The outer end of the speed-regulation valve core 701 is provided with a speed-regulation knob 703 which can drive the speed-regulation valve core to rotate so as to switch between various air guide holes and the air release passage. In this embodiment, there are two air guide holes 702 disposed along the outer circumference of the speed-regulation valve core 701 at an angle of 90° with respect to each other. The inner end of the speed-regulation valve core 701 is axially positioned at the valve body 102 through a hexagon-socket head-cap screw 704, a spring washer 705, and a speed-regulation valve pad 706 to be capable of rotation yet incapable of axial movement. Two sets of left and right speed-regulation valve O-rings 707 seal between the speed-regulation valve core 701 and the air release passage 303 to ensure that the high pressure air can only be guided outward via the air guide hole 702 in order to prevent leaking. A rotary positioning steel ball 708 is provided between the speed-regulation valve core 701 and the valve body 102. The side of the speed-regulation knob 703 facing the valve body 102 has a counterbore 709 in which a spring for rotary positioning 710 is disposed. The rotary positioning steel ball 708 is located in the counterbore 709 and is pressed against an outer end of the spring for rotary positioning 710. The rotary positioning steel ball 708 is always pressed against the outer surface of the valve body 102 to be slidable thereon under the tension of the spring for rotary positioning 710.

As shown in FIGS. 11, 12, 13, and 14, the pull-bolt assembly 22 comprises a pull-bolt pull bar 801 and a pull-bolt thimble 802. The portion of the pull-bolt pull bar 801 that extends out of the gun support is provided with a pull-bolt handle 803. The pull-bolt thimble 802 has a top end capable of magnetically attracting a steel pellet. In this embodiment, the pull-bolt thimble 802 has a hole formed at its top end. A magnetic shaft 804 capable of magnetically attracting the steel pellet is provided in the hole. A damping rubber seal ring 805 is provided at the root of the pull-bolt thimble 802. An elastic rubber seal ring 806 capable of self-locking upon loading by the pull-bolt thimble 802 is provided around the outer circumference of the pull-bolt thimble 802. A cylindrical hang pin 807 is attached to the pull-bolt thimble 802.

According to an improvement, one end of the pull-bolt pull bar 801 is rotatably connected to the gun support through a rear shaft pin 808. The pull-bolt handle 803 is fixed to the other end of the pull-bolt pull bar 801. A pull-bolt connection bar 809 is rotatably connected to the middle portion of the pull-bolt pull bar 801. One end of the pull-bolt connection bar 809 is rotatably connected to the pull-bolt pull bar 801 through a rear shaft pin 810 of the connection bar. The other end of the pull-bolt connection bar 809 is rotatably connected to the pull-bolt thimble 802 through a front shaft pin 811 of the connection bar.

Figure 15:
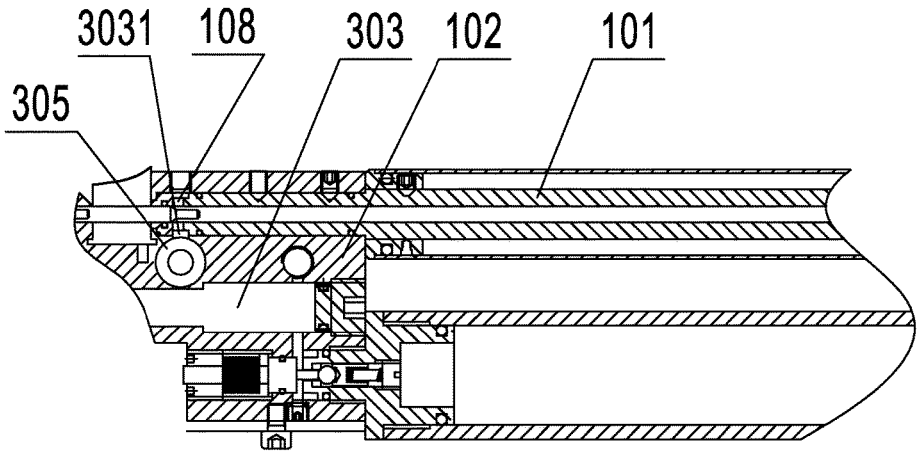
FIG. 15 is a cross-sectional structural view of a valve body, a barrel, and a speed-regulation valve core when assembled.
Figure 16:
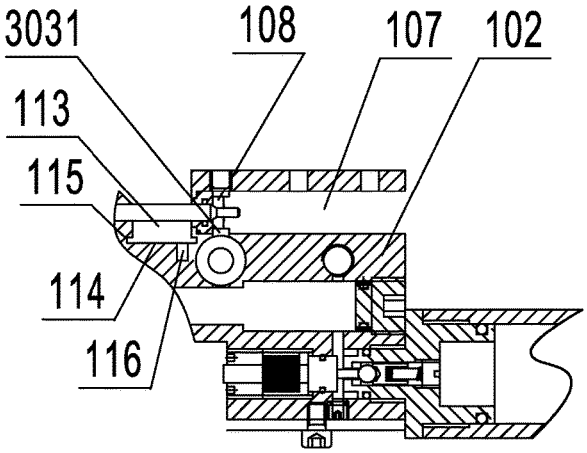
FIG. 16 is a schematic cross-sectional structural view of the valve body.
Figure 17:
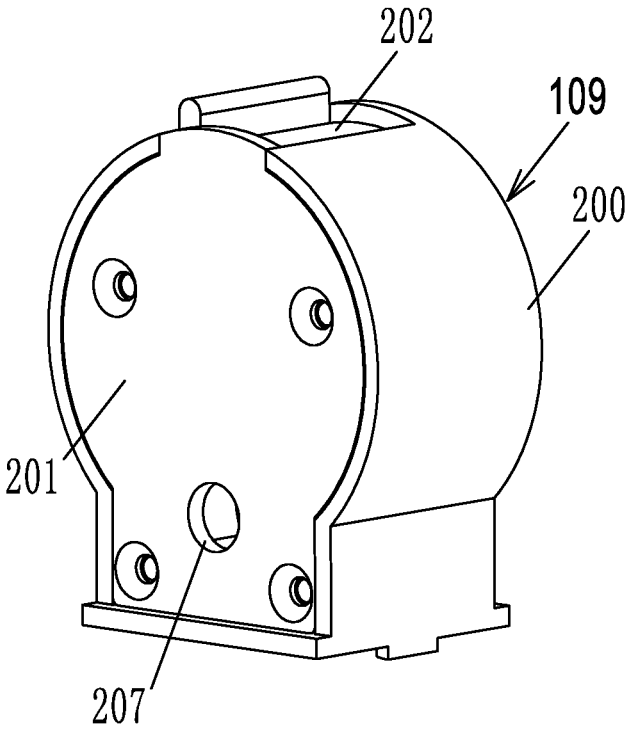
FIG. 17 is a first schematic structural view of a magazine case.
Figure 18:
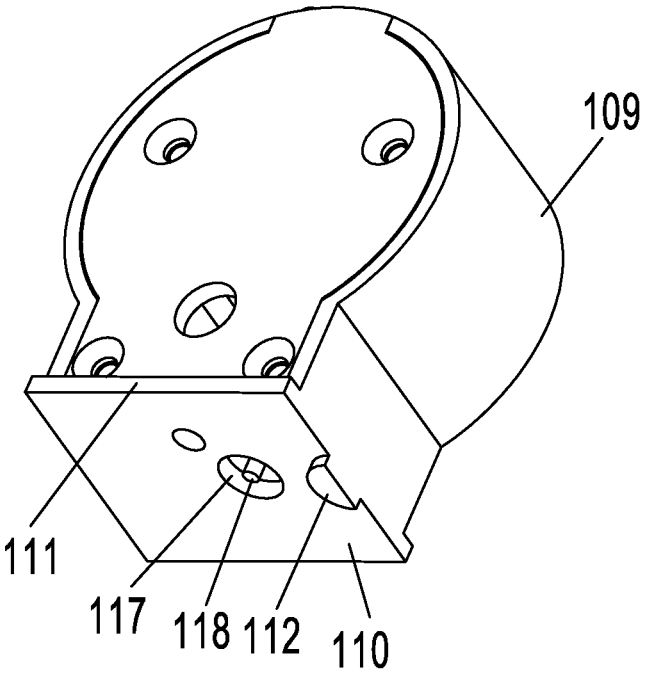
FIG. 18 is a second schematic structural view of a magazine case.
Figure 19:
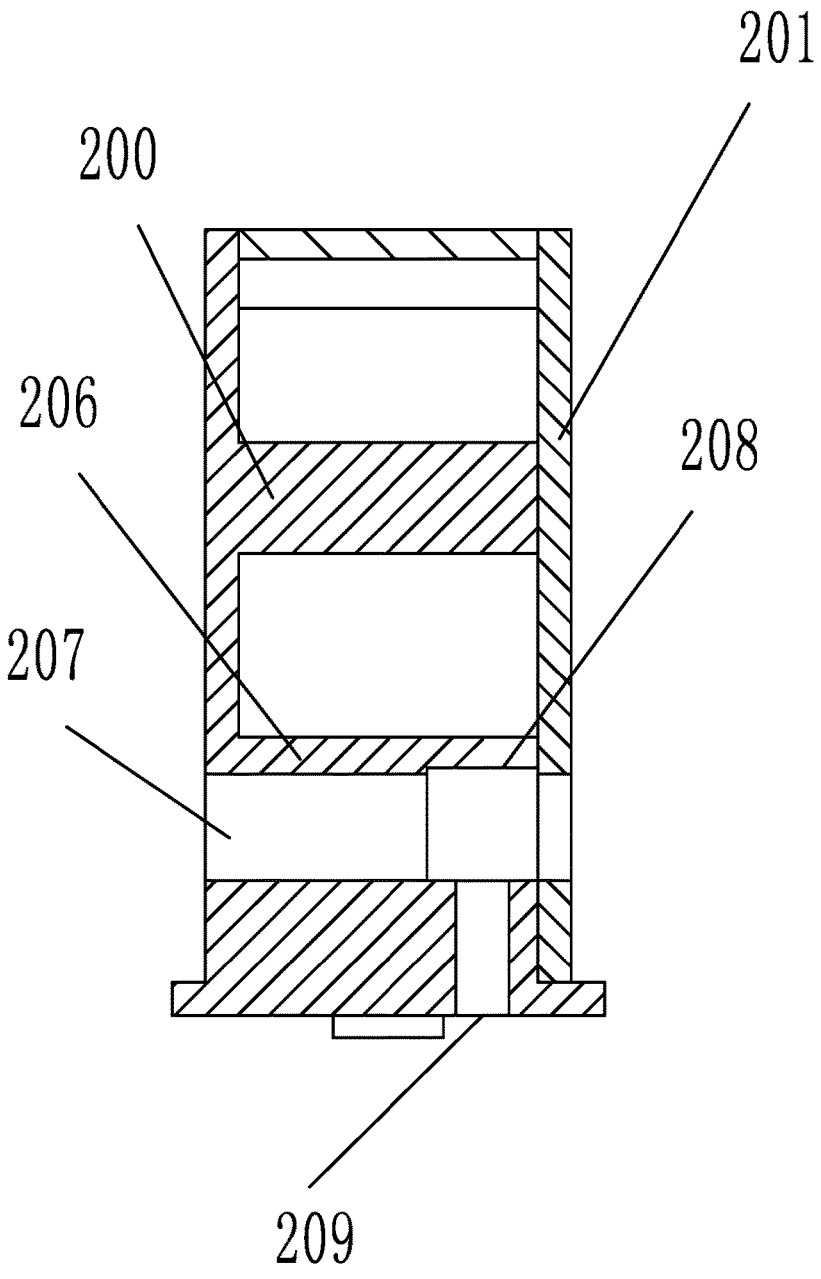
FIG. 19 is a schematic cross-sectional structural view of a loading sleeve opening and a shaft bore in the magazine case.
Figure 20:
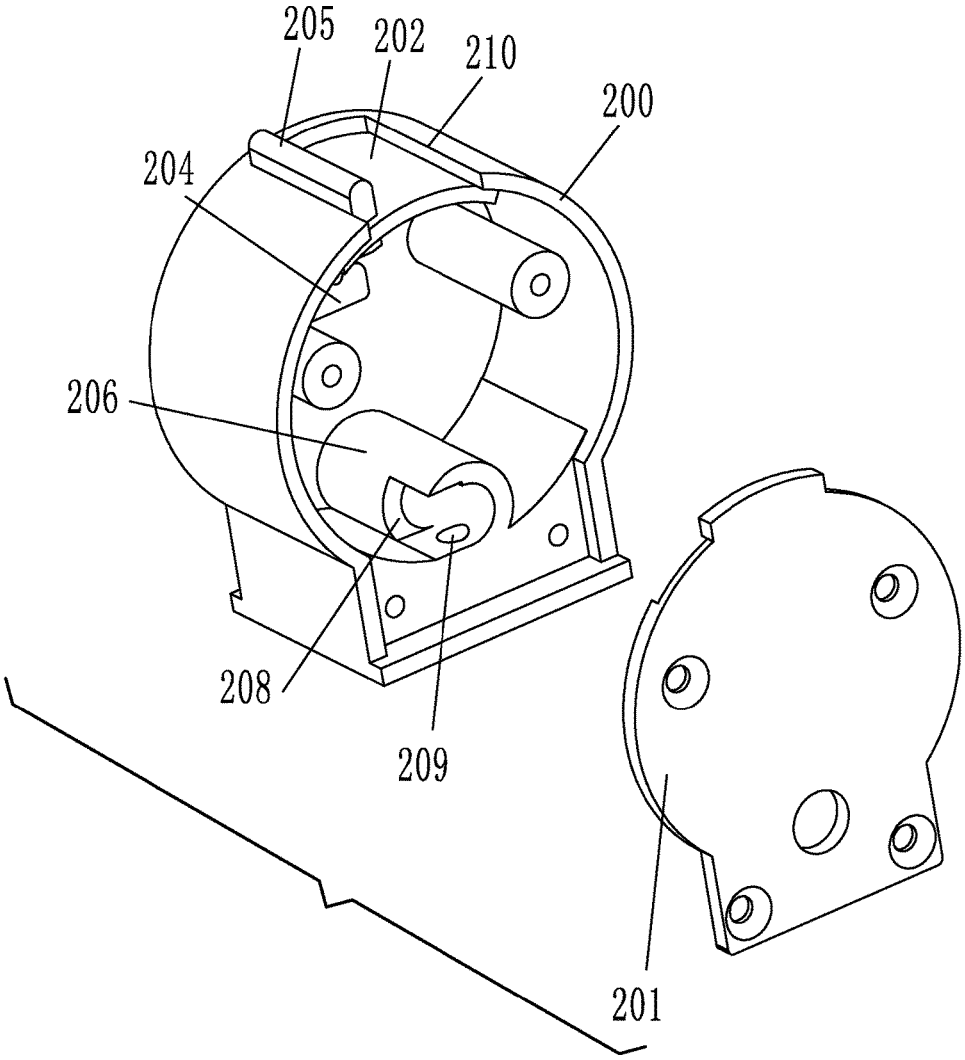
FIG. 20 is a schematic structural view of the magazine case when disassembled.

As shown in FIGS. 1, 15, and 16, a tube 107 for mounting the barrel is provided in the valve body 102. The inner end of the barrel 101 extends into the tube 107. The air release passage 303 comprises two or more inlet holes 3031 in communication with the tube 107. The inlet holes 3031 each have an inner diameter smaller than an outer diameter of the pellet. For ease of arrangement of the inlet holes 3031, an annular groove 108 is provided at the inner end wall of the tube 107. The bottom of the groove 108 is in communication with each of the inlet holes.

As shown in FIGS. 1, 16, 17, 18, 19, and 20, a magazine is detachably connected to the gun support 100. The magazine comprises a pellet clip seat 200, a pellet clip lid 201, a pellet clip closure 202, and a magnetic shaft (not shown). The pellet clip seat 200 and the pellet clip lid 201 are interlocked through a screw to form a magazine case 109 of a pellet loader. A pellet inlet 210 is formed at the upper end of the magazine case 109. The pellet clip closure 202 is rotatably connected to the magazine case for opening or closing of the pellet inlet 210. In this embodiment, a fold edge 204 is provided at the inner bottom wall of the pellet clip seat 200. A positioning slot is formed between the fold edge 204 and the inner wall of the pellet clip seat 200. The pellet clip closure 202 has a handle 205. When the pellet clip closure 202 is rotated to close the pellet inlet 210, the edge of the pellet clip closure 202 is inserted in the positioning slot.

The bottom side wall of the pellet clip seat 200 is provided with a loading sleeve 206 that extends to the pellet clip lid. The center hole of the loading sleeve 206 passes perpendicularly through the pellet clip seat 200. The pellet clip lid 201 comprises a loading channel 207 for the pull-bolt thimble to pass through. The end of the loading sleeve 206 close to the exit side of the loading channel 207 comprises an opening 208 through which a single pellet can slip autonomously into the loading channel. The bottom of the loading channel 207 comprises a shaft bore 209 close to the opening 208 that is in communication with the loading channel 207. The magnetic shaft is fitted tightly inside the shaft bore 209. The magnetic shaft is a magnet shaft which can magnetically attract a steel pellet entering the loading channel 207 through the opening 208 to the top end thereof. An upper end of the magnetic shaft is flush with an upper edge of the shaft bore 209 or hidden inside the shaft bore 209.

In this embodiment, the magazine case 109 is inserted in a groove 113 of the valve body 102. The bottom of the magazine case 109 is provided with an inverted T shaped connector 110. The connector 110 comprises a clamping edge 111 protruding outward on both sides of its bottom and a positioning block 112 protruding downward at one side of its bottom end. The bottom of the groove 113 is provided with a connector slot 114 capable of mating to the connector 110, and the bottom of the connector slot 114 is provided with a positioning counterbore 116 capable of mating to the positioning block 112. Both side walls of the connector slot 114 are provided with a concave bayonet 115. One of the side clamping edges 111 of the connector 110 can be inserted into one of the side bayonets 115 at an angle. The other side clamping edge 111 of the connector 110 can be folded down to be clamped into the other bayonet 115 to achieve clamping connection of the magazine. The positioning block 112 protrudes into the positioning counterbore 116 when the connector 110 is fully clamped in the connector slot 114.

In this embodiment, the groove 113 has an internal space that matches the shape of the magazine. For ease of inclined clamping of the magazine, the groove 113 has an inclined side wall, so that the magazine inserted in the groove 113 can be inclined toward the inclined side wall and clamped in the slot 114 at the bottom of the groove 113.

In this embodiment, the lower end face of the connector 110 has a counterbore 117. A pillar 118 is provided at the center of the counterbore 117 and hidden inside the counterbore 117. An O-shaped rubber ring is positioned in the counterbore 117 and tightly fitted on the pillar 118, with its outer side protruding from the lower end face of the connector 110. When the magazine is clamped in the groove 113, the O-shaped rubber ring maintains an opposing thrust to the magazine to enable a tight engagement between the slot and the magazine, thereby achieving a secure connection between the groove 113 and the magazine.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A pneumatic air gun, comprising:

a gun support;

a barrel disposed on the gun support;

a valve body;

a pressure gauge;

an air compression assembly;

an energy storage assembly; and a triggering assembly;

wherein the air compression assembly is connected to the energy storage assembly, and the energy storage assembly is connected to the valve body;

the triggering assembly comprises a trigger support fixed to the gun support, and a pull-bolt assembly, a trigger, a trigger button, and a hammer which are disposed on the trigger support;

a spring is attached to the hammer; the trigger is connected to the trigger button;

the pull-bolt assembly comprises a loading thimble adapted to slide on the gun support; the loading thimble is movably connected to the hammer and adapted to control the hammer to reset and clamp on the trigger button;

the energy storage assembly comprises an air pump and a check valve disposed at one end of the air pump; the air pump is a three-stage air pump;

the valve body comprises an air release passage adapted to connect the check valve and the barrel;

the air release passage is provided with an air release valve for controlling an opening and closing of an air channel; the air release passage between the air release valve and the barrel is provided with a speed-regulation valve for regulating an air flow; the air release valve is provided with a slider for controlling the opening or closing of the air release passage; and the slider is positioned at the end of a striking travel of the hammer.

2. The gun of claim 1, wherein the three-stage air pump further comprises a front fixed sheath, a rear fixed sheath, a front movable sheath, a rear movable sheath, a relatively large tube, a medium tube, a relatively small tube, and a piston rod; an intake sleeve on the check valve is sealed and fixedly connected in the rear fixed sheath;

front and rear ends of the relatively large tube are sheathed tightly on the front fixed sheath and the rear fixed sheath, respectively; the front fixed sheath and the rear fixed sheath are both fixedly connected to the gun body support through a connection portion that extends out of the relatively large tube; an O-ring of the relatively large tube seals between an inner wall of a rear end of the relatively large tube between an outer wall of the rear fixed sheath;

the front movable sheath is positioned at a front portion of the relatively large tube; a steel ball is provided on an outer circumference of the front movable sheath; the front movable sheath is slidably mated to the inner wall of the relatively large tube through the steel ball; the rear movable sheath is positioned at a rear portion of the relatively large tube; a first-stage piston cup is provided between the outer wall of the rear movable sheath and the inner wall of the relatively large tube; the first-stage piston cup, which is opened upon air admission and closed upon air compression, is fixed to the outer wall of the rear movable sheath;

the medium tube is coaxially disposed in the relatively large tube; the front and rear ends of the medium tube is tightly sheathed in the front movable sheath and rear movable sheath respectively; the relatively small tube is coaxially disposed in the medium tube; the rear end of the relatively small tube is sealed and fixedly connected in an intake sleeve on the check valve; a second-stage piston cup is provided between the inner wall of the rear movable sheath and the outer wall of the relatively small tube; the second-stage piston cup, which is closed upon air admission and opened upon air compression, is fixed to the inner wall of the rear movable sheath;

the piston rod is positioned in the relatively small tube; one end of the piston rod extends out of the relatively small tube and is hinged to the front movable sheath through a pin shaft of the front movable sheath; a third-stage piston cup is provided between the other end of the piston rod and the inner wall of the relatively small tube; the third-stage piston cup, which is opened upon air admission and closed upon air compression, is fixed to a piston head of the piston rod; and the air compression assembly comprises a connection bar and a compression bar; one end of the connection bar is rotatably connected to the front movable sheath through a pin shaft of the connection bar; the compression bar is rotatably connected to the front fixed sheath through a front pin shaft of the compression bar; the other end of the connection bar is rotatably connected to a middle portion of the compression bar through a rear pin shaft of the compression bar.

3. The gun of claim 1, wherein the air release valve comprises a valve core shaft, an air release valve spring, and a valve cover; the valve core shaft is sheathed in the valve cover to be axially slidable and is controlled by the air release valve spring to reset; the valve cover comprises an axial airflow through hole and a circumferential outlet port that is in communication with the airflow through hole; a step is circumferentially arranged on and protrudes from the inner wall of the airflow through hole; one end of the valve cover is an inlet port and the other end of the valve cover is connected with the slider that has a hat shape; the slider is positioned in the valve cover and axially slidably mated to the valve cover; the valve core shaft is axially slidably mated to the step; an inner end of the valve core shaft extends into the slider to be fixedly connected with the slider; a first O-ring is provided between the valve core shaft and the valve cover; the first O-ring is fitted tightly on the valve core shaft and can abut on the stage face of the step; the other side of the O-ring is also provided with a gasket which is fitted tightly on the valve core shaft and abuts against the first O-ring; the gasket is slidably mated to the inner wall of the valve cover; one end of the air release valve spring is pressed against the gasket and the other end of the air release valve spring is pressed against the slider; the outer end of the valve core shaft has a large tip which can be snugly fitted to the inlet port of the valve cover; a second O-ring is provided between the large tip and an end face of the intake port for sealing the intake port; the second O-ring is provided on the end face of the intake port or the large tip.

4. The gun of claim 1, wherein the speed-regulation valve comprises a speed-regulation valve core which is pivotally mounted in the air release passage and can be rotated about a center thereof; the speed-regulation valve core is arranged perpendicularly to the air release passage; the speed-regulation valve core is provided with a plurality of air guide holes; the air guide holes are arranged along an outer circumference of the speed-regulation valve core at an angle with respect to one another and pass through the speed-regulation valve core radially; each of the air guide holes has a diameter different from one another; an end of the speed-regulation valve core extends out of the valve body; an outer end of the speed-regulation valve core is provided with a speed-regulation knob which can drive the speed-regulation valve core to rotate so as to switch between various air guide holes and the air release passage.

5. The gun of claim 4, wherein a rotary positioning steel ball is provided between the speed-regulation valve core and the valve body; a counterbore is provided on one side of the speed-regulation knob that faces the valve body; a spring for rotary positioning is provided in the counterbore; the rotary positioning steel ball is positioned in the counterbore and is pressed against an outer end of the spring for rotary positioning; the rotary positioning steel ball is always pressed against an outer surface of the valve body to slide thereon under the tension of the spring for rotary positioning.

6. The gun of claim 1, wherein the pull-bolt assembly comprises a pull-bolt pull bar and a pull-bolt thimble; a portion of the pull-bolt pull bar that extends out of the gun support is provided with a pull-bolt handle; the pull-bolt thimble has a top end capable of magnetically attracting a steel pellet.

7. The gun of claim 6, wherein a top end of the pull-bolt thimble is formed with a bore in which a magnetic shaft capable of magnetically attracting a steel pellet is provided.

8. The gun of claim 1, wherein the valve body is provided with a tube for mounting a barrel; an inner end of the barrel extends into the tube; the air release passage comprises two or more inlet holes in communication with the tube; each inlet hole has an inner diameter smaller than an outer diameter of the pellet.

9. The gun of claim 1, wherein a magazine comprising a pellet clip seat, a pellet clip lid, a pellet clip closure, and a magnetic shaft is detachably connected to the air gun support; the pellet clip seat and the pellet clip lid are connected to constitute a magazine case that comprises a pellet inlet on an upper end of the magazine case; the pellet clip closure is rotatably connected to the magazine case for opening or closing of the pellet inlet; a bottom side wall of the pellet clip seat is provided with a loading sleeve that extends to the pellet clip lid; a center hole of the loading sleeve is perpendicularly penetrated through the pellet clip seat; the pellet clip lid comprises a loading channel for the pull-bolt thimble to pass through; the loading sleeve comprises an opening at one end thereof close to an exit side of the loading channel through which a single pellet can slip autonomously into the loading channel; a bottom of the loading channel comprises a shaft bore close to the opening that is in communication with the loading channel; the magnetic shaft is tightly fitted in the shaft bore; the magnetic shaft is a magnet shaft capable of magnetically attracting a steel pellet that enters the loading channel through the opening to the top end thereof; an upper end of the magnetic shaft is flush with an upper edge of the shaft bore or hidden inside the shaft bore; and an upper end of the valve body is provided with a groove for inserting the magazine case into the valve body; the magazine case is inserted in the groove; the bottom of the magazine case is provided with an inverted T shaped connector; the connector comprises a clamping edge protruding outward on both sides of a bottom of the connector and a positioning block protruding downward at one side of a bottom end of the connector; a bottom of the groove is provided with a connector slot capable of mating to the connector, a bottom of the connector slot is provided with a positioning counterbore capable of mating to the positioning block; both side walls of the connector slot are provided with a concave bayonet; one of the side clamping edges of the connector is inserted into one of the side bayonets at an angle; the other side clamping edge of the connector can be folded down to be clamped in the other bayonet to achieve a clamping connection of the magazine; the positioning block protrudes into the positioning counterbore when the magazine case is fully clamped in the connector slot.

10. The gun of claim 9, wherein a lower end face of the connector is provided with a counterbore; a pillar is provided at a center of the counterbore; the pillar is hidden inside the counterbore; an O-shaped rubber ring is positioned in the counterbore and tightly fitted on the pillar; and the O-shaped rubber ring protrudes from the lower end face of the connector.

* * * * *